United States Patent [19]

Ligman et al.

[11] 4,206,491

[45] Jun. 3, 1980

[54] ENTRY SYSTEM

[75] Inventors: James R. Ligman; Peter Kaufman; Harry W. Kompanek, all of Santa Barbara, Calif.; David K. Carlson, Belleville, Mich.

[73] Assignee: KKF Corporation, Santa Barbara, Calif.

[21] Appl. No.: 25,646

[22] Filed: Mar. 30, 1979

Related U.S. Application Data

[63] Continuation of Ser. No. 821,437, Aug. 3, 1977, abandoned.

[51] Int. Cl.[2] ..... E05B 49/00

[52] U.S. Cl. ..... 361/172; 307/10 AT

[58] Field of Search ..... 361/170–172; 70/153, 278; 340/63, 64, 147 MD, 164 R, 164 A, 167, 274; 307/10 AT

[56] References Cited

U.S. PATENT DOCUMENTS

| | | | |
|---|---|---|---|
| 3,691,396 | 9/1972 | Hinrichs | 361/172 |
| 3,710,316 | 1/1973 | Kromer | 361/172 |
| 3,766,522 | 10/1973 | Marsh | 361/172 X |
| 3,784,839 | 1/1974 | Weber | 361/172 |
| 3,796,889 | 3/1974 | Fradkin et al. | 361/172 |
| 3,831,065 | 8/1974 | Mastin et al. | 361/172 |
| 3,845,361 | 10/1974 | Watase et al. | 361/172 |
| 4,062,056 | 12/1977 | Goodrich | 361/172 |

*Primary Examiner*—Harry E. Moose, Jr.
*Attorney, Agent, or Firm*—Anthony J. Criso

[57] ABSTRACT

A keyless system especially useful in controlling the doors and trunk of an automobile is disclosed. The overall system usually comprises an input station containing a keyboard, a signal processor, signal amplification means and an electromechanical grouping which converts the electrical output from the amplifier to mechanical movement in control of a lock. The system is activated by a touch control at the input keyboard and with the power section of the system energized, the lock is controlled in response to a proper sequence of digital input signals created by the operator. The input at the control station is described in terms of a keyboard having five selectors and resulting in approximately three thousand possible combinations for the base code. The signal processor responds to correct combinations of digital inputs with a drive signal. The signal processor is also programmable with temporary convenience codes which are loaded into the logic portion of the system with access preconditioned on entry of the base code.

5 Claims, 8 Drawing Figures

62
60
1
2
3
4
5
6
7
8
9
0
58
64
66
68
70
52

16
50
SIGNAL PROCESSOR
18
SIGNAL AMPLIFIER
44
46
48
RELAY
54
42

ENTRY SYSTEM

This is a continuation of application Ser. No. 821,437 filed Aug. 3, 1977, now abandoned.

BACKGROUND OF THE INVENTION

1. Field of the Invention

The present invention relates to controlled access and more particularly to systems which are operable without a key and are especially adaptable for application in vehicles such as automobiles.

2. Description of the Prior Art

After automobiles gained general acceptance by the consuming public, mechanisms were devised for the purpose of limiting their closure and operation. The conventional key operated tumbler lock was readily available for such applications as doors, glove boxes, trunks and ignitions on automobiles, although security devices operable without a key were soon being sought.

One such system is described in U.S. Pat. No. 1,251,365 entitled Permutation Lock which involves relatively complicated interlock mechanisms using electromagnets to position tumblers in a bolt which controls the movement of a mechanical component intended to be locked. The system is button operated and the buttons must be pushed in a preselected sequential order for operation. The system is considered mechanically complex, heavy and bulky and is generally unsuited for many current day automobile applications.

In U.S. Pat. No. 1,298,177 entitled Combination Lock for Automobiles, the inventors describe a somewhat analogous system using a plurality of interchangeable keys having selected areas of conducting and nonconducting surfaces thereon such that when the keys are mechanically adjusted by the operator to a prearranged disposition, various electrical circuits are completed and the interlock is bypassed. Another very old system is described in U.S. Pat. No. 1,587,757 entitled Automobile Lock which is electromechanical in nature and is operable by properly inserting a plug into one of a plurality of receptacles and manipulating the position of the plug. The concepts in each of these two patents are feasible but impractical by current day standards because of their size, complexity and relatively inflexible codeability.

More recent variations of the relatively cumbersome locking systems described above are disclosed in U.S. Pat. No. 2,819,770 entitled Means for Securing a Motor Vehicle Against Theft and U.S. Pat. No. 2,964,733 entitled Automobiles or Like Vehicles Fitted with Theft Prevention Devices.

The inventors of Door Locking Means disclose in U.S. Pat. No. 3,353,383 a combination lock mechanism that must be properly decoded before a latch member can be actuated to allow a door to be opened. The system is operated by push buttons and is essentially mechanical in nature, being organized such that if the push buttons are not operated in the suitable sequence, not only is the latch mechanism not free to move but an alarm is thereby triggered. As is the case with much of the preceding art, the workable system is relatively complex, heavy and inflexible. Further, such mechanical systems tend to be relatively large, expensive, and limited in their applicability due to such factors as size, reliability and environmental sensitivity.

In U.S. Pat. No. 3,024,452 entitled Multi-Digit Electrical Door Lock, the inventors disclose a system which is more electrical in nature. A group of push buttons is combined with suitable circuits which respond to a preselected input. In the event the buttons are operated in a wrong sequence, the electrical circuitry causes the system to become immobilized and an alarm is initiated. The system is further characterized in that the code to which the system will respond can be changed by mechanical manipulation of provided selectors. Another concept is disclosed in U.S. Pat. No. 3,192,448 entitled Keyless Electric Lock wherein a lock bolt is actuated when the available switches are activated in a preselected sequence in order to activate a solenoid in the system.

While some of the more recent inventions are clear improvements over the preexisting art, the various security systems available can be characterized as mechanically oriented although some do involve electromechanical or electrical activation mechanisms. Nevertheless, such systems are relatively massive, complex and rigid and although their codes may be changed, such changes ordinarily require mechanical manipulation of certain variable components. The automobile industry in particular currently looks forward to a consumer oriented security system having good market acceptance. Such systems should be easily operable, include a capacity to change the access mode quickly and easily, and retain the secureness and reliability of the overall locking system in an inexpensive and rugged embodiment of reasonable size and weight.

SUMMARY OF THE INVENTION

A primary object of the present invention is to control access to a vehicle or other enclosure with a mechanism which is operable without a key.

According to the present invention, a Keyless Entry TM system comprises a control station including a keyless electrical signal generator, logic means for processing suitable electrical signals from the control station, and means responsive to the logic output for controlling a mechanism such as a lock. Typically, a digital electrical signal is produced at the manual control station by sequential operation of a plurality of sensitized touch points. The signal is directed to a logic means which compares the generator signal with a reference code and under acceptable conditions can be programmed to accept a subsequent convenience code, and provide an output which is amplified and directed to an electric motor to change the physical position of a restraint in the entry system.

The manual generation of the electrical signals at a sealed control station and the processing of such signals in electronic circuitry are principal features of the present invention. Various codes arbitrarily selected by an operator having a base code can be programed into the system. The control station is activated with ordinary finger pressure and can be conveniently sized to be packaged to fit an ordinary door handle found on an automobile. The door latch mechanism is either locked or unlocked in response to a coded sequence of electric pulses which may be either permanent or temporary. The control station has a finger sensitive keyboard and often contains piezoelectric switches, a positive contact indicator and a light for illuminating the keyboard. The invention can be operated with various response functions, particularly in automobile applications including activation of the interior light, unlocking of the hood, and activation of the ignition circuit or an anti-theft alarm.

The present invention is attractive in appearance and is essentially weatherproof when installed in an automobile door. The system provides improved security and can eliminate the need for a key. The keyboard is simple to operate, can be contained within a modest space allotment, permits the use of ten digits and the concomitantly large number of possible combinations of coded signals for activation.

The foregoing and other objects, features and advantages of the present invention will become more apparent in the light of the following detailed description of preferred embodiments thereof as shown in the accompanying drawing.

DESCRIPTION OF A PREFERRED EMBODIMENT

Figure 1:
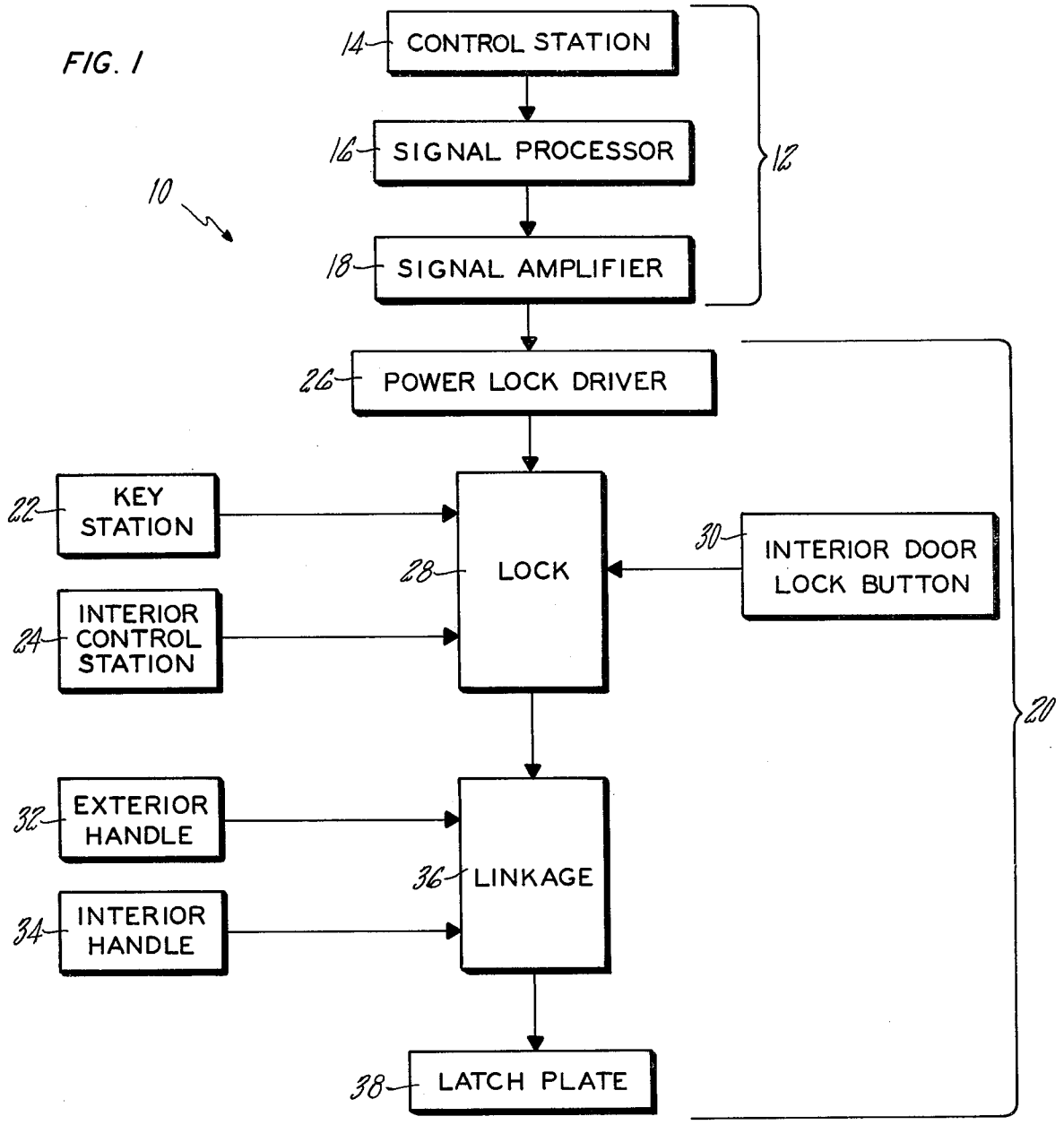
FIG. 1 is a block diagram of an overall system in accordance with the present invention.

A sketch of a simplified Keyless Entry system in accordance with the present invention is shown in FIG. 1. The system as disclosed is a device which is suitable for mounting in the door of a conventional automobile and the entire nonmechanical portion of this system is typically packaged in a volume represented by an ordinary bar of soap.

In FIG. 1, an overall lock system 10 is shown with an electronics grouping 12 comprising a control station 14, a signal processor 16 and a signal amplifier 18, and an electromechanical grouping 20 comprising an exterior key station 22, an interior control station 24, a power lock driver 26, a lock 28, an interior door lock button 30, an exterior handle 32 an interior handle 34, linkage 36 and a latch plate 38.

Figure 2:
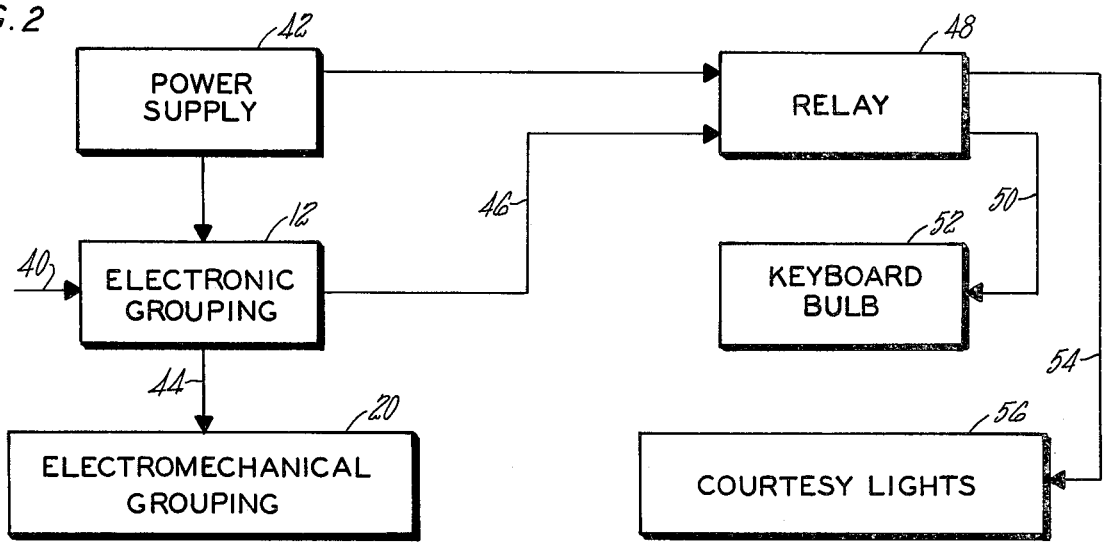
FIG. 2 is a block diagram with representations for some of the more significant interacting components in a system on an automobile.

A release sequence of the lock system can be described in terms of the block diagrams shown in FIGS. 1 and 2. An operator produces an input signal sequence 40 at the control station. The signal sequence is processed electronically and compared with a reference signal in an electric circuit including a power supply 42, all of which is described in more detail hereinafter. The input sequence which suitably match a coded reference sequence in the processor pass to the signal amplifier to provide an electronics grouping output signal 44. The power level of the signal 44 is sufficient to activate the power lock driver which is an element in the electromechanical grouping 20 and is typically a solenoid or a motor. A cycle of the lock driver moves the lock per se, eliminates a restraint in the linkage 36, and either the exterior handle 32 or the interior handle 34 may be manipulated causing the linkage 36 to throw the latch plate 38 thereby releasing the entry member such as a door or trunk lid. In addition to the door lock actuation, the signal 44 can be used to drive various other functional sequences if so desired. Alternatively either the exterior key station 22 located on the outside of the door or the interior control station 24 can control the mechanical grouping. These two sites operate independent of the grouping 12 and allow the door lock to be actuated from inside the enclosure with a simple switch or from outside the enclosure with an optional key which is usable in the conventional manner as an alternate method of entry.

In an electric circuit which is essentially in parallel with the electronics grouping output signal 44, a relay trigger signal 46 from the grouping 12 triggers a relay 48 connected to the power supply to provide various outputs as shown in FIG. 2. For example, a first relay output 50 energizes a keyboard bulb 52 mounted proximate to the control station 14, and a second relay output 54 activates a group of courtesy lights 56 interior of the car.

Figure 3:
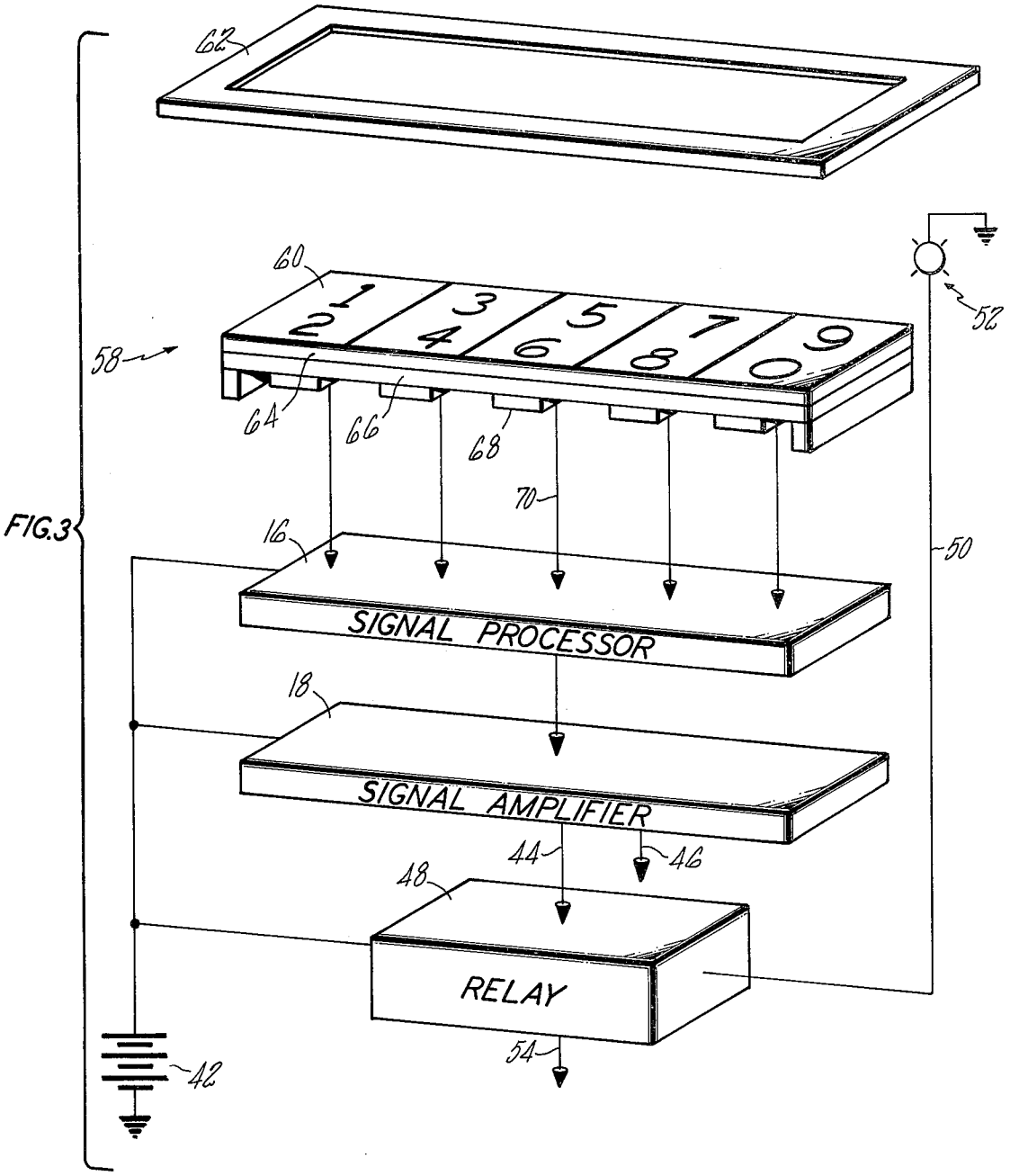
FIG. 3 is an exploded perspective view of a representative lock module used in the system.

An exploded perspective view of a preferred Keyless Entry module 58 is shown in FIG. 3. The assembly comprises a touchplate 60, a coverplate 62, the keyboard bulb 52, the signal processor and the signal amplifier. Also shown for the purpose of clarity are the relay 48 and the power supply 42. The touchplate comprises a substrate 64 which is electrically conductive and usually a metal, a layer 66 of piezoelectric material and a plurality of electrodes 68. The application of pressure such as can be applied with the touch of a finger at one of the number locations generates a voltage between the substrate and the adjacent electrode and results in the touchplate signals 70 which are directed into the signal processor 16. A more extensive discussion of the details of construction and operation for a touchplate of the type described is provided in U.S. patent (U.S. application Ser. No. 748,993) entitled Signal Generator which was filed on Dec. 9, 1976 and is held with the present invention by a common assignee. While the piezoelectric touchplate has been found to be particularly suited for the module construction, more ordinary apparatus such as push buttons or toggle switches alone or in combination with a flexible boot are also feasible.

Figure 4:
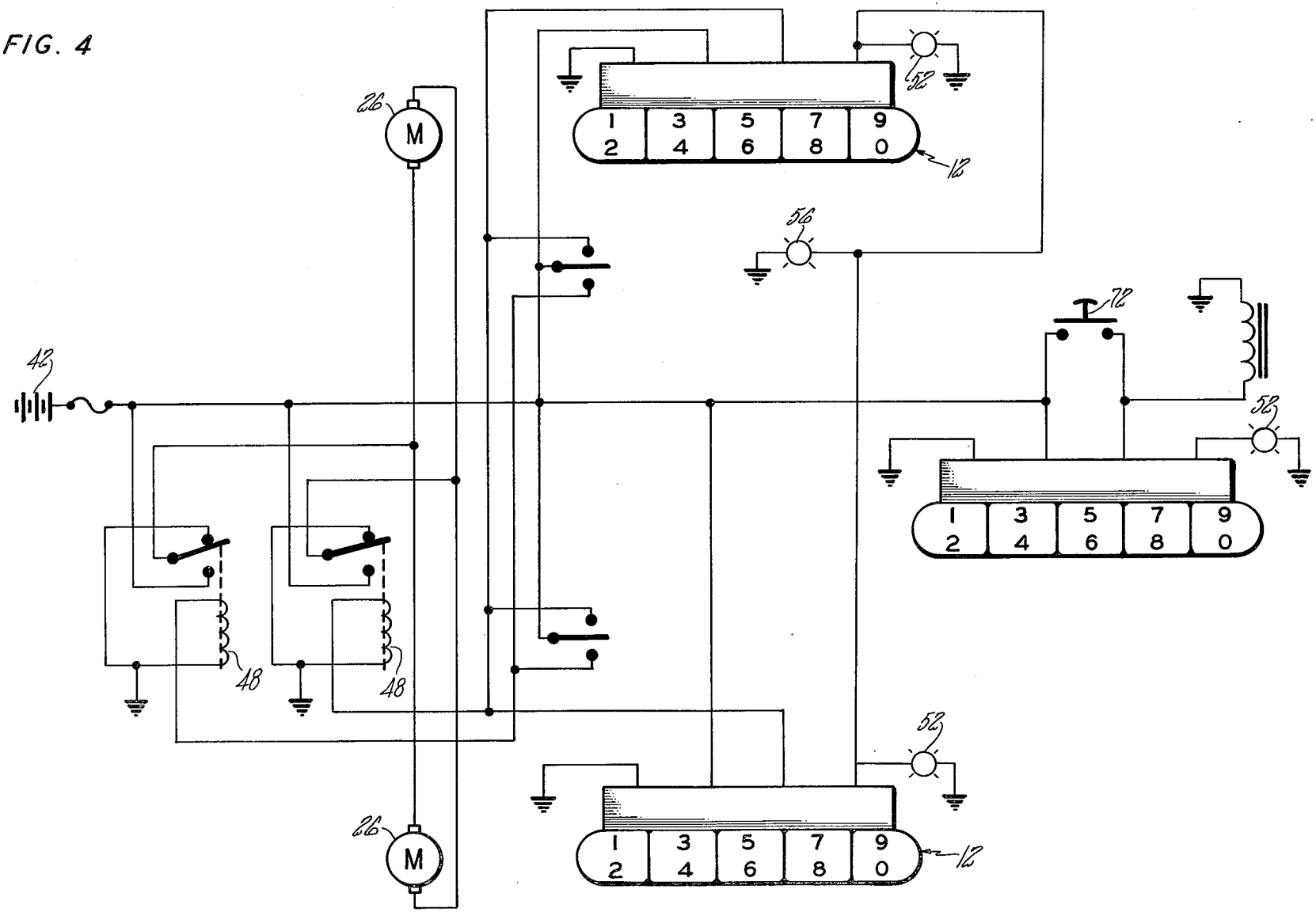
FIG. 4 is a simplified schematic of a Keyless Entry system designed for an automobile installation.

A schematic representation of an entry system as applied to a two-door automobile is shown in FIG. 4. The system is simplified considerably to show a representative electrical network suitable for supporting two door locks and one trunk lock. Most of the elements shown have been described previously in the block diagram descriptions although a trunk release switch 72 which is commonly located in the glove box of an automobile is also included. In a typical application the keyboard and courtesy lamps shown are lighted for a period of ten to fifteen seconds after the final entry is made at the control station.

When the present invention is committed to an application such as access through a door or the trunk in a passenger car, the overall operation involves the keyless control of the logic system in combination with a power door lock. Typically, the fingers of the operator contact the touchplate and when a sufficient force which is ordinarily in the range of a few ounces to a few pounds is applied thereto, a voltage is generated between the touchplate and an electrode. As soon as such a signal is generated from any one or more of the touchplate electrodes, the associated input signal activates the relay 48 and triggers multiple responses. The first output signal 50 from the relay energizes the keyboard bulb 52 so that during periods of limited visibility, the operator can be accurately selective in his manipulations at the touchplate. In addition, the relay produces the second output which activates the courtesy lights in the automobile enabling the operator to view the entire interior prior to unlocking and entering the vehicle.

The entire grouping 12 namely the control station, the signal processor and the signal amplifier is relatively simple and compact. The volume of such a package is typically three to five inches in length and perhaps an inch wide and an inch deep. In addition to being readily enclosed, the module as described herein includes no buttons or mechanical switches so that the entire package can be made relatively insensitive to the environmental conditions and more specifically waterproof. This feature alone is very desirable since the difficulty and inconvenience of a frozen key lock is avoided. The dimensions of the module are convenient for integrating the package into either the conventional side door locks or trunk lock presently found on automobiles.

The entry system has a permanent signal sequence stored in the signal processor and anytime the correct code is introduced at the control station, various prearranged output signals are generated allowing the electromechanical grouping and the systems responsive to the relay to be operated. This code may be for the embodiment shown, any five digit number based on the numerals zero through nine. The touchplate 60 as shown in FIG. 3 has five pads or touchpoints each of which is associated with two numerals and a single corresponding electrode. The arrangement makes available a greater flexibility in numerical code selection although the number of statistical combinations possible with the five electrode system which is approximately three thousand does not change. Five input locations are considered convenient to allow a sufficiently large reserve of possible combinations to accommodate the door locking requirements in an automobile application.

The permanent or base code which will operate the system described is known to a limited number of operators and thereby guarantees limited access to the vehicle without the necessity for carrying a key. However, under some circumstances, an operator may wish to provide entry to the automobile for a limited duration of time. Under these circumstances, the operator can provide temporary access to the system by entering the base code followed quickly by touching the one/two digit location and then entering a convenience code. The entry of a convenience code is controllable by alternative conditions precedent as well, the more immediate of which include the use of the door key at station 22 or entry of a particular program sequence other than a single signal from the one/two digit location. Since the system will respond to either the base code or the convenience code, the operator can provide a person such as a parking lot attendant with the temporary access by revealing to him a convenience code. When the operator wishes to revoke such access, he merely enters the base code which erases the temporary access code. Similarly the circuitry can be allowed to respond in a manner whereby a base code entry followed by entry of the one/two indicator clears the previously stored convenience code. This programable feature of the system can be used repeatedly with the same or different convenience access codes being provided at the will of the operator who is cognizant of the base code.

Figure 5:
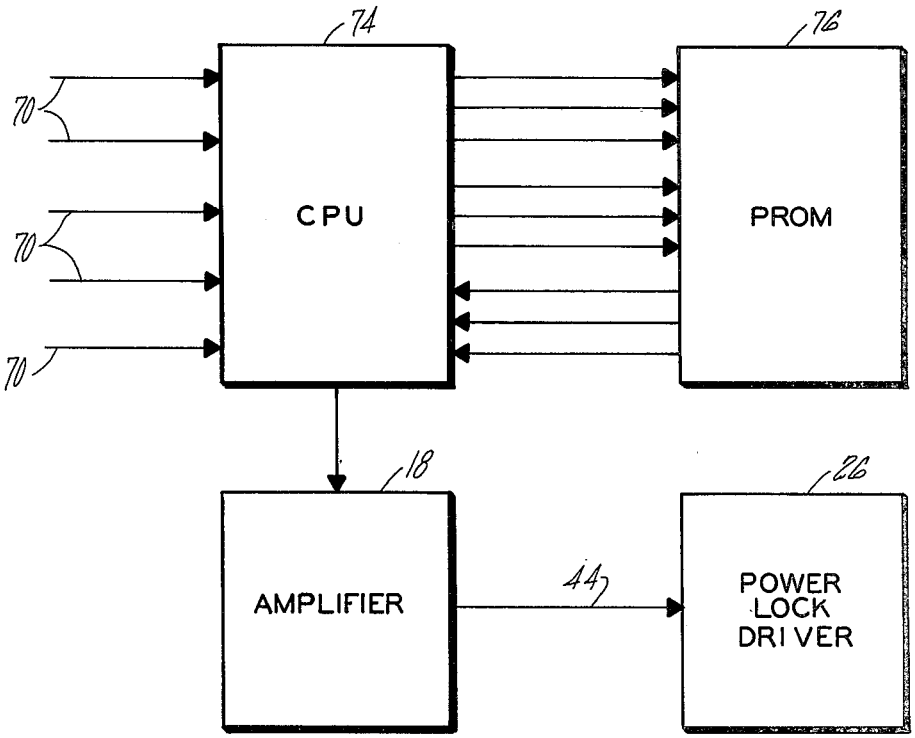
FIG. 5 is a functional block diagram of the lock module.

The essence of a typical signal processor 16 is shown in block diagram form in FIG. 5. The five touchplate signals 70 are entered into a central processing unit (CPU) 74 which communicates with a programable read only memory (PROM) 76 and together provide a signal which is increased in power in the amplifier 18 and appears ultimately as the output signal 44 which drives the power lock driver 26.

Figure 6:
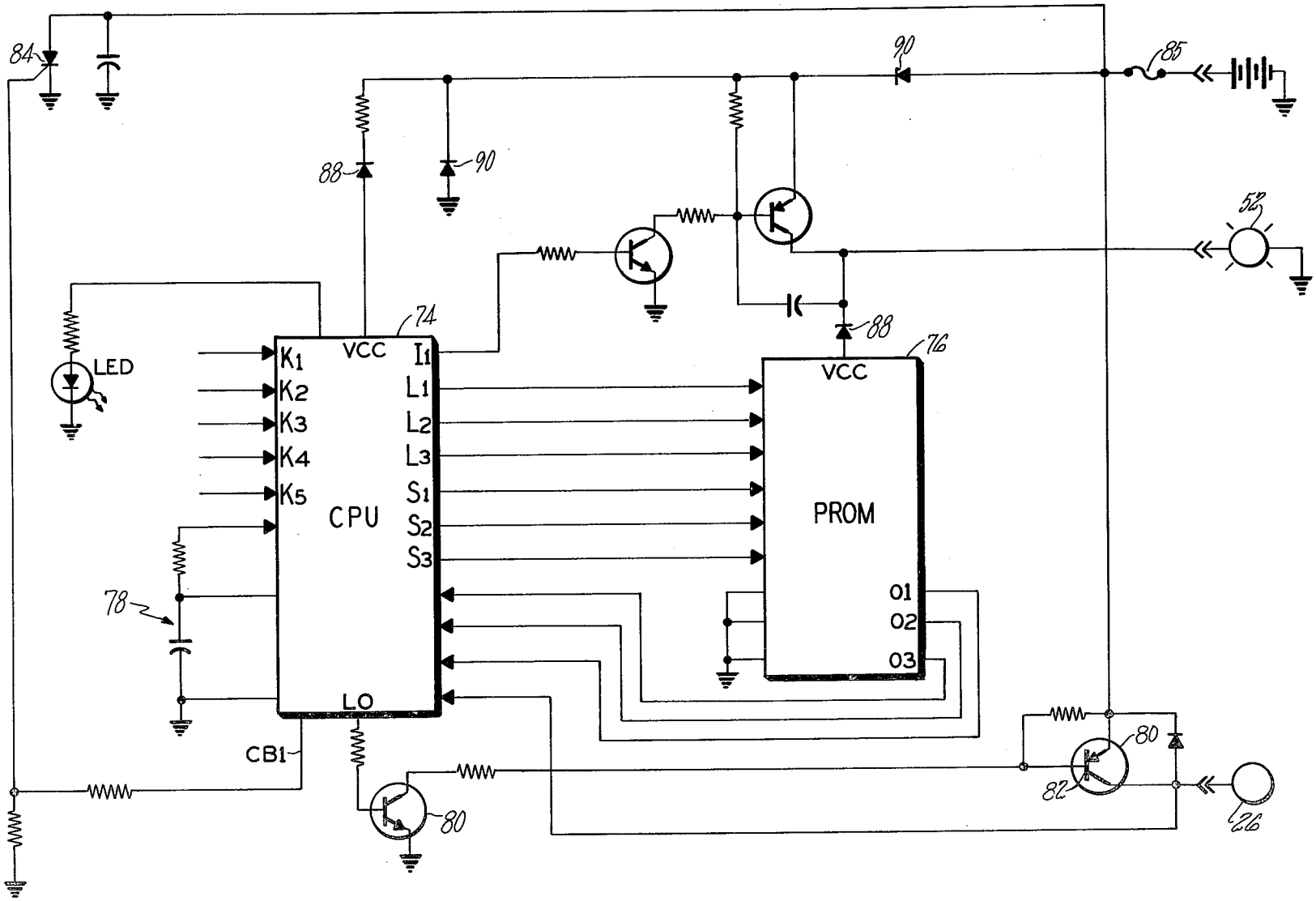
FIG. 6 is a simplified circuit diagram corresponding to the block diagram of the lock module.

Actual wiring for connecting the integrated circuits with the associated element is shown schematically in FIG. 6. The entry module 58 as shown in detail in FIG. 3, contains five distinct number locations, each of which produces an output signal represented as K1 through K5 on the CPU. The K1 through K5 signals are typically two or three volt sine waves with some noise present. These K signals are decoded to binary form resulting in signal L1 through L3. The CPU generates signals S1 through S3 which correspond to the sequence of K signals. These six output lines then address a programable read only memory (PROM) 76 and generate corresponding outputs 01 through 03 which are entered into CPU which then become the next sequence number S1 through S3. Therefore for every K1 through K5 input this is in the proper order, a new sequence number is obtained (S1–S3, 01–03). This process continues until the unlock sequence number is obtained and a signal is generated at L0. If an out of sequence K1 through K5 is input, the PROM generates sequence 000 at 01 through 03 and the combination must start over. A grounded network 78 generates a clock frequency for the purpose of synchronizing all the internal signals on the CPU and generating the feedback to the CPU which is present at all times on output L0. Once the correct coded sequence of numbers is introduced at K1 through K5, a signal is generated at output L0 which powers two amplifier transistors 80 thereby driving the lock mechanism.

Faults are detected in the transistors 80 with the previously mentioned feedback signal which is always present on output L0. As long as the transistors are operating correctly this feedback is present also at collector 82. The signal is not present in the event either of the transistors fail. Should this occur, immediately following the next clock signal, a pulse is generated at CB1 output which turns on the silicon controlled rectifier 84 and blows a fuse 85 disconnecting the power supply. With this protective circuit, no failure of the transistors 80 is capable of turning on the output and actuating the lock mechanism.

The CPU also generates signals in response to random keyboard inputs, which result in the illumination of the touchplate through amplifying transistors 86 and the light emitting diode (LED) shown in FIG. 6. An LED is sometimes incorporated into the system somewhere on the keyboard as a positive feedback indicator. The use of an LED in this manner allows the operator to confirm visually that each input motion is in fact producing the intended input electric signal. A pair of diodes 88 is provided essentially to regulate the current supply to the integrated circuits and a pair of second diodes 90 protect against overvoltages and reverse polarity of the power supply. During long periods of nonuse, the quiescent current draw of the circuit should be minimized and therefore, the programmable read only memory has power only during the time that the touchplate is illuminated which is typically approximately ten seconds.

Figure 7:
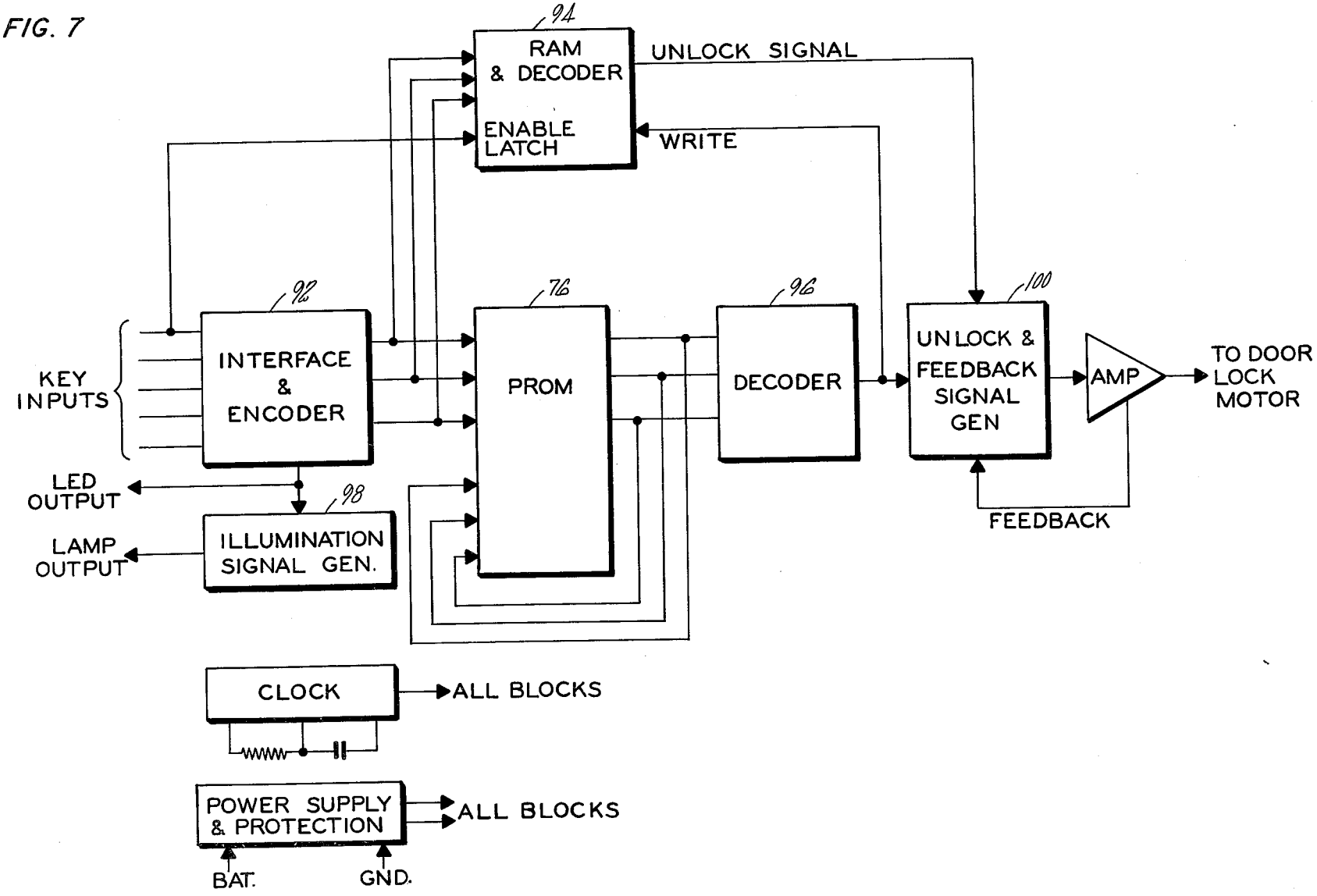
FIG. 7 is a functional block diagram of the central processing unit and programmable read only memory elements of the module.

A functional block diagram of the CPU and the PROM is provided in FIG. 7. The interface area 92, a random access memory and decoder 94, a decoder 96 and an illumination signal generator 98 for the illumination time delay and an unlock signal generator 100 are shown. Provision for a clock to synchronize all of the signals present, means for protecting the integrated circuitry, and a power-on resetter are also shown.

Figure 8:
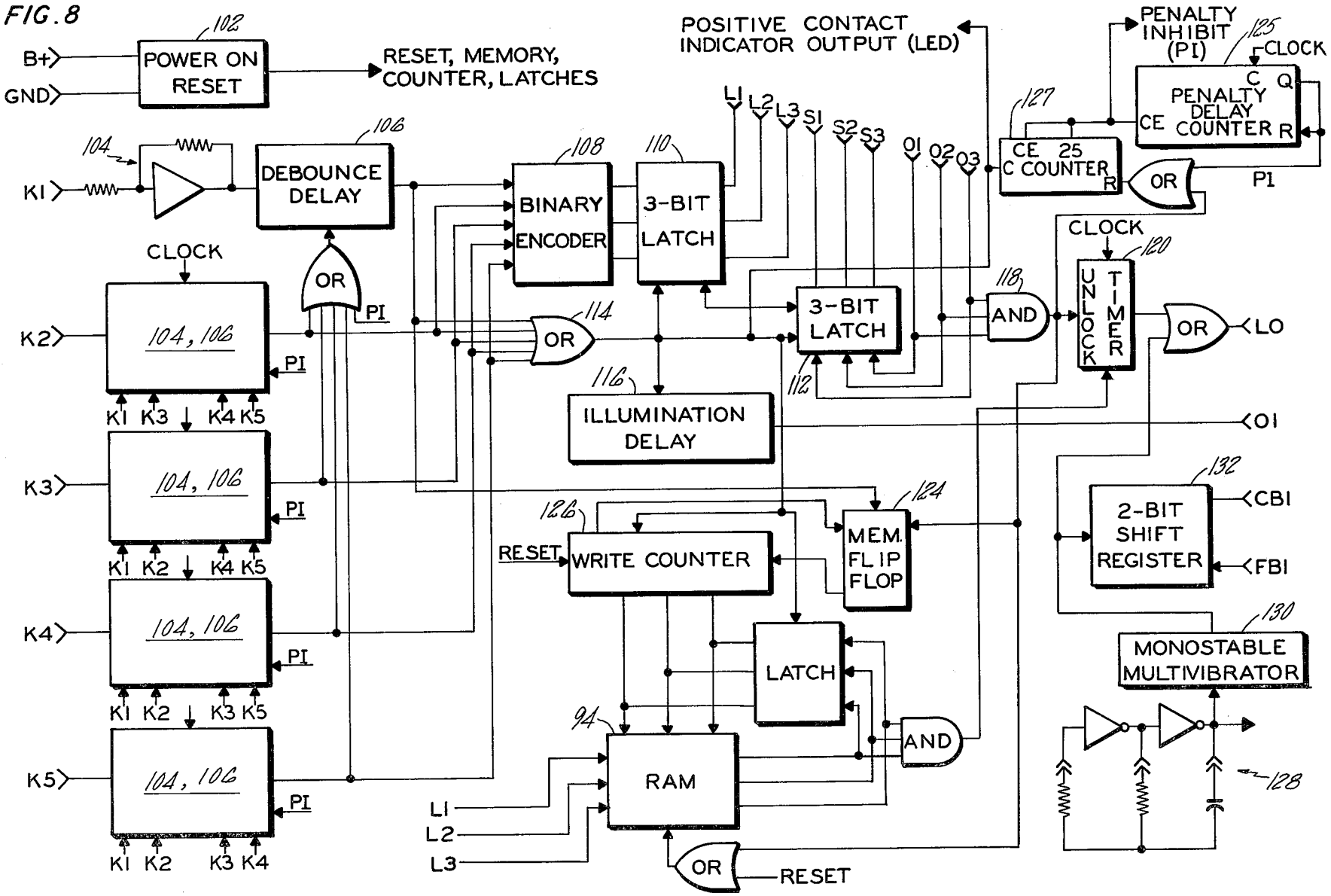
FIG. 8 is a simplified circuit diagram of the central processing unit.

A somewhat detailed schematic of the integrated circuitry of the CPU is described in FIG. 8. A power-on reset circuit 102 protects the circuitry from overvoltages and eliminates spurious signals which occasionally develop and might otherwise activate the power locks. At each input station K1 through K5, a Schmitt trigger 104 is provided to square the input wave and a debounce delay circuit 106 is provided to prevent false inputs due to either a low power or noisy signal. The debounced circuit also prevents the simultaneous actuation of more than one key. Rather than to attempt the unwieldly task of handling five individual parallel input lines, the output from the debounce circuit is processed through a binary encoder 108 and stored in a three bit latch 110 for addressing the programmable read only memory shown previously. The latch prevents the loss of signal once the key input is removed. A second three bit latch 112 receives outputs 01 through 03 from the programmable read only memory and stores such outputs as part of the address for that same programmable read only memory. In this manner, the coded sequence occurs only if the correct address is inserted in the programmed sequence. An OR gate 114 generates the appropriate signals to strobe the latches and trigger an illumination delay 116 which is ordinarily ten to fifteen seconds, a period during which the keyboard and courtesy lights are energized.

After a correct permanent code sequence has been accepted, and AND gate 118 triggers an unlock timer 120 which simultaneously resets the temporary storage means in the random access memory (RAM) 94. A subsequent signal from K1 triggers a memory flip-flop 124 allowing the next five K1 through K5 signals to be read into the random access memory and the memory flip-flop resets. A penalty delay counter 125 and a counter 127 are incorporated to inhibit rapid and continuous sequential operation of all possible codes. Typically after a predetermined number, twenty five for example, of keystrokes is accomplished with the generation of an unlock signal, the penalty time delay counter is enabled to inhibit subsequent input signals during the next several seconds or longer.

A write counter 126 provides a number sequence which becomes half of the address for the random access memory. The remainder of the address comes from the key address outputs L1 through L3 and the correct sequence is generated by the same feedback scheme used in the programable read only memory, namely, for the normal sequencing of the convenience code, each input must be preceded by a correct input in order to have present the correct address for the input in question. When the address at the output of the random access memory is correct, the unlock timer 120 is triggered to generate an appropriate unlock signal. A clock circuit 128 comprising inverters, feedback resistors and capacitors as is well known, in combination with a monostable multivibrator 130 provides a very short signal pulse which also appears at the lock output if there is no unlock signal thereby providing extremely narrow pulses to the output transistors to detect correct operation. The extremely narrow output pulse is fed back at FB1 into a two bit shift register 132 so that if two successive signals are not detected at the collector of the last output transistor 80, an output CB1 will be generated to blow the fuse 85.

The apparatus and circuitry discussed above are oriented primarily toward automobile entry applications in order to describe a complete system in an understandable context. However, the invention has utility over a wide range of applications which include garage and other door operation in commercial and private buildings, access to equipment such as copying or automated credit machines, elevator or automobile ignition operation, and entry to restricted recreational facilities.

Although the present invention has been shown and described with respect to preferred embodiments thereof, those skilled in the art should understand that various changes and omissions in the form and detail thereof may be made therein without departing from the spirit or scope of the invention.

Having thus described a typical embodiment of our invention, that which we claim as new and desire to secure by Letters Patent of the United States is:

1. A control system comprising:

a control station including an entry module which is responsive to manual inputs and has a plurality of juxtaposed locations each capable of providing an electrical signal, particular series of which form signal sequences with each individual electrical signal being identifiable with a particular one of such locations;

an electrical signal processor for providing a processor output signal in response to any preselected signal sequence from the entry module, the processor including, means for retaining a base code as a first preselected code, and for comparing a signal sequence produced at the entry module with the base code, and for providing a processor output signal each time a signal sequence matches the base code which is permanently incorporated into the base code retaining means and is incapable of modification or elimination by signals from the entry module, and means for retaining a convenience code as a second preselected code, and for comparing a signal sequence produced at the entry module with the convenience code, and for providing a processor output signal each time a signal sequence matches the convenience code which is incorporated into the convenience code retaining means from the entry module alone by entering in order the base code followed by a manual input from at least one preselected location at the entry module and finally a series of manual inputs arbitrarily selected by the operator to become the convenience code;

amplification means for increasing the power of the processor output signal; and means responsive to amplification means for controlling the operability of an apparatus used in combination with the control system.

2. An entry system comprising:

a movable member the position of which determines the accessibility to a system or an enclosure;

actuation means for changing the position of the movable member;

means for controlling the movement of the actuation means;

a control station having input means which are responsive to manual inputs including a plurality of discrete locations capable of producing an electric signal characteristic of each location;

an electrical signal processor having means for retaining as a base code a preferred order of such electrical signals and for comparing as an input the actual order in which electrical signals are produced by the input means to provide a processor output signal each time an input code matches the base code which is permanently incorporated into the base code retaining means and is incapable of modification or elimination by signals from the input means, the electrical signal processor also having means for retaining until programmed otherwise from the control station a sequence of electrical signals constituting a convenience code which allows the signal processor to respond to electrical signals produced at the control station and provide a processor output signal each time an input code matches either the base or the convenience code;

amplification means for increasing the power level of the processor output signals; and means responsive to the amplifier for moving the means controlling the movement of the actuation means.

3. The invention according to claim 2 wherein the input means comprises a keyboard having a smooth uninterrupted surface and each discrete location thereon responds to touch to provide an electrical signal characteristic of each such location.

4. For an enclosure having a door containing lock means, means for controlling entry to the enclosure comprising:

a control station including means for initiating a sequence of electrical pulses in response to manually applied inputs such pulse initiating means being accessible from the enclosure exterior;

signal processor means which accepts pulse sequences from the pulse initiating means and contains a base code which is permanently fixed in the processor, the processor being capable of comparing such pulses with the base code and producing a drive signal in response to each set of electrical pulses matched to the base code, the signal processor having means for receiving and retaining until programmed otherwise from the pulse initiating means alone a convenience code which is received subsequent to and in combination with the base code, the signal processor including means for comparing pulse sequences from the control station with the convenience code and for providing a drive signal in response to each pulse sequence which matches either the base code or the convenience code; and means for amplifying the drive signal to a power level sufficient to operate the lock.

5. In a vehicle having a door containing a power lock, means for controlling the lock comprising:

a control station located at the door exterior and including means for producing pulse electrical signals in response to manual inputs;

signal processor means containing a base code for receiving electrical signals from the control station, for comparing such signals with the base code, and for providing a drive signal whenever the input electrical signals from the control station match the base code which is permanently incorporated into the signal processor means and is incapable of modification or elimination by signals from the control station, and means for accepting and retaining until programmed otherwise with the control station by a series of electrical pulses delivered to the processor in combination with the base code, such series constituting a convenience code which allows the signal processor to respond to electrical signals produced at the control station and provide a processor output signal each time a series of signals matches either the base code or the convenience code; and means for amplifying the drive signal to a power level sufficient to drive the power lock.

* * * * *